United States Patent [19]

Chung

[11] Patent Number: 4,735,736

[45] Date of Patent: Apr. 5, 1988

[54] VISCOSITY INDEX IMPROVER-DISPERSANT ADDITIVE

[75] Inventor: David Y. Chung, Edison, N.J.

[73] Assignee: Exxon Chemical Patents Inc., Linden, N.J.

[21] Appl. No.: 752,530

[22] Filed: Jul. 8, 1985

[51] Int. Cl.[4] ..... C10M 133/16

[52] U.S. Cl. ..... 252/48.6; 252/51.5 A; 252/56 D; 252/56 R; 525/299; 525/301

[58] Field of Search ..... 252/51.5 A, 33, 34, 252/48.6, 56 D, 56 R; 525/301, 299

[56] References Cited

U.S. PATENT DOCUMENTS

| | | | |
|---|---|---|---|
| 3,903,003 | 9/1975 | Murphy et al. | 252/51.5 A |
| 4,077,893 | 3/1978 | Kiovsky | 252/56 R |
| 4,089,794 | 5/1978 | Engel et al. | 252/51.5 A |
| 4,132,661 | 1/1979 | Waldbillig et al. | 252/51.5 A |
| 4,137,185 | 1/1979 | Gardiner et al. | 252/51.5 A |
| 4,141,847 | 2/1979 | Kiovsky | 252/51.5 A |
| 4,144,181 | 3/1979 | Elliott et al. | 252/33 |
| 4,160,739 | 7/1979 | Stambaugh et al. | 252/51.5 A |
| 4,161,452 | 7/1979 | Stambaugh | 252/34 |
| 4,171,273 | 10/1979 | Waldbillig et al. | 252/51.5 A |
| 4,219,432 | 8/1980 | Girgenti et al. | 252/51.5 A |
| 4,282,132 | 8/1981 | Benda et al. | 252/51.5 A |
| 4,320,019 | 3/1982 | Hayashi | 252/51.5 A |

FOREIGN PATENT DOCUMENTS

| | | |
|---|---|---|
| 785496 | 12/1979 | South Africa . |
| 2055852A | 3/1979 | United Kingdom . |
| 1578049 | 10/1980 | United Kingdom . |

*Primary Examiner*—William R. Dixon, Jr.
*Assistant Examiner*—Margaret B. Medley
*Attorney, Agent, or Firm*—F. T. Johmann; M. B. Kapustij

[57] ABSTRACT

Oil soluble hydrocarbon polymers, useful as V.I. improvers, such as ethylene copolymer, preferably ethylene-propylene copolymer, are grafted with an unsaturated acid material, such as maleic anhydride, preferably by solid state grafting followed by reaction with a polyamine, preferably a tertiary-primary amine, and treatment and/or reaction with monoamine. The resulting material is used in oil compositions, such as lubricating oil, as a Viscosity Index improver having sludge dispersancy properties. The monoamine treatment inhibits viscosity growth of the additive upon storage.

18 Claims, No Drawings

VISCOSITY INDEX IMPROVER-DISPERSANT ADDITIVE

BACKGROUND OF THE INVENTION

1. Field of the Invention

The invention relates to polymeric viscosity index (V.I.) improvers—dispersant additives for synthetic and petroleum oils, particularly lubricating oils, methods for their preparation, and oil compositions containing them. These additives comprise a hydrocarbon polymer, for example a copolymer of ethylene with one or more $C_3$ to $C_{28}$ alpha-olefins, preferably propylene, or a hydrogenated copolymer of styrene and butadiene or isoprene, etc., which has been grafted with an acid moiety, e.g. maleic anhydride, followed by reaction with a polyamine, preferably a tertiary polyamine having only a single acetylable amine group, followed by reaction with ammonia or monoamine.

2. Prior Disclosures

Hydrocarbon polymers, particularly ethylenepropylene copolymers, are in widespread use as viscosity index (V.I.) improving additives for oil compositions, particularly lubricating oil compositions. A substantial body of prior art exists directed towards further reacting these ethylene V.I. improvers to form a multi-functional V.I. improver. This is a material useful as a V.I.—dispersant oil additive so as to improve not only the V.I. properties of the oil but to also impart dispersancy so as to suspend sludge that may form during the operation or use of the lubricant and to inhibit varnish deposition in engines. Various patents teach grafting ethylene copolymers with maleic anhydride, followed by reaction with an amine. A number of these prior disclosures teach reducing or avoiding the use of polyamine having two primary amine groups to thereby reduce crosslinking problems which become more of a problem as the number of amine moieties added to the polymer molecule is increased in order to increase dispersancy. Generally, these patents used a primary-tertiary amine.

German Published Application No. P3025274.5 teaches an ethylene copolymer reacted with maleic anhydride in oil using a long chain alkyl hetero or oxygen containing amine.

U.S. Pat. No. 4,132,661 grafts ethylene copolymer, using peroxide and/or air blowing, with maleic anhydride and then reacts with a primary-tertiary diamine.

U.S. Pat. No. 4,160,739 teaches an ethylene copolymer which is grafted, using a free radical technique, with alternating maleic anhydride and a second polymerizable monomer such as methacrylic acid, which materials are reacted with an amine having a single primary, or a single secondary, amine group.

U.S. Pat. No. 4,171,273 reacts an ethylene copolymer with maleic anhydride in the presence of a free radical initiator and then with mixtures of $C_4$ to $C_{12}$ n-alcohol and amine such as N-aminopropylmorpholine or dimethylamino propyl amine to form a V.I.-dispersant-pour depressant additive.

German published application No. 2753569.9 shows an ethylene copolymer reacted with maleic anhydride by a free radical technique and then reacted with an amine having a single primary group.

German published application No. 2845288 grafts maleic anhydride on an ethylene-propylene copolymer by thermal grafting at high temperatures and then reacts with amine having one primary group.

French published application No. 2423530 teaches the thermal reaction of an ethylene copolymer with maleic anhydride at 150° to 210° C. followed by reaction with an amine having one primary or secondary group.

The use of non-ethylene hydrocarbon polymers to form V.I.-dispersant additives is also known in the art such as those of U.S. Pat. Nos. 3,903,003; 4,077,893 and 4,141,847.

Generally speaking, while the use of amines having a single primary group, such as primary-tertiary amines, can reduce cross-linking and gelling, particularly at relatively high levels of maleic anhydride grafting, an undesirable high degree of viscosity increase may still occur. The present invention represents a further improvement over the prior art, wherein this viscosity increase can be further inhibited by treatment with aliphatic monomaines.

DESCRIPTION OF PREFERRED EMBODIMENT

Hydrocarbon Polymer

Oil soluble hydrocarbon polymers or copolymers used in the invention generally will have a number average molecular weight ($\overline{M}_n$) of from about 5000 to about 500,000; preferably 10,000 to 200,000 and optimally from about 20,000 to 100,000. In general, polymers useful as V.I. improvers will be used. These V.I. improvers will generally have a narrow range of molecular weight, as determined by the ratio of weight average molecular weight ($\overline{M}_w$) to number average molecular weight ($\overline{M}_n$). Polymers having a ($\overline{M}_w/\overline{M}_n$) of less than 10, preferably less than 7, and more preferably 4 or less are most desirable. As used herein ($\overline{M}_n$) and ($\overline{M}_w$) are measured by the well known techniques of vapor phase osmometry (VPO), membrane osmometry and gel permeation chromotography. In general, polymers having a narrow range of molecular weight may be obtained by a choice of synthesis conditions such as choice of principal catalyst and cocatalyst combination, addition of hydrogen during the synthesis, etc. Post synthesis treatment such as extrusion at elevated temperature and under high shear through small orifices, mastication under elevated temperatures, thermal degradation, fractional precipitation from solution, etc. may also be used to obtain narrow ranges of desired molecular weights and to break down higher molecular weight polymer to different molecular weight grades for V.I. use.

Examples of suitable hydrocarbon polymer include homopolymers and copolymers of two or more monomers of $C_2$ to $C_{28}$, e.g. $C_2$ to $C_{18}$ olefins, including both alpha olefins and internal olefins, which may be straight or branched, aliphatic, aromatic, alkylaromatic, cycloaliphatic, etc. Frequently they will be of ethylene with $C_3$ to $C_{28}$ olefins, particularly preferred being the copolymers of ethylene and propylene, and polymers of other olefins such as propylene, butene and polyisobutylene. Also homopolymers and copolymers of $C_6$ and higher alpha olefins can be preferably employed.

Such hydrocarbon polymers also include olefin polymers such as atactic polypropylene, hydrogenated polymers and copolymers and terpolymers of styrene, e.g. with isoprene and/or butadiene.

The preferred polymers are prepared from ethylene and ethylenically unsaturated hydrocarbons including cyclic, alicyclic and acyclic, containing from 3 to 28 carbons, e.g. 2 to 18 carbons. These ethylene copolymers may contain from 15 to 90 wt. % ethylene, preferably 30 to 80 wt. % of ethylene and 10 to 85 wt. %, preferably 20 to 70 wt. % of one or more $C_3$ to $C_{28}$, preferably $C_3$ to $C_{18}$, more preferably $C_3$ to $C_8$, alpha olefins. While not essential, such copolymers preferably have a degree of crystallinity of less than 25 wt. %, as determined by X-ray and differential scanning calorimetry. Copolymers of ethylene and propylene are most preferred. Other alpha-olefins suitable in place of propylene to form the copolymer, or to be used in combination with ethylene and propylene, to form a terpolymer, tetrapolymer, etc., include 1-butene, 1-pentene, 1-hexene, 1-heptene, 1-octene, 1-nonene, 1-decene, etc.; also branched chain alpha-olefins, such as 4-methyl-1-pentene, 4-methyl-1-hexene, 5-methylpentene-1, 4,4-dimethyl-1-pentene, and 6-methylheptene-1, etc., and mixtures thereof.

The term copolymer as used herein, unless otherwise indicated, includes terpolymers, tetrapolymers, etc., of ethylene, said $C_{3-28}$ alpha-olefin and/or a non-conjugated diolefin or mixtures of such diolefins which may also be used. The amount of the non-conjugated diolefin will generally range from about 0.5 to 20 mole percent, preferably about 1 to about 7 mole percent, based on the total amount of ethylene and alpha-olefin present.

Representative examples of non-conjugated dienes that may be used as the third monomer in the terpolymer include:

a. Straight chain acyclic dienes such as: 1,4-hexadiene; 1,5-heptadiene; 1,6-octadiene.
b. Branched chain acyclic dienes such as: 5-methyl-1,4-hexadiene; 3,7-dimethyl 1,6-octadiene; 3,7-dimethyl 1,7-octadiene; and the mixed isomers of dihydro-myrcene and dihydro-cymene.
c. Single ring alicyclic dienes such as: 1,4-cyclohexadiene; 1,5-cyclooctadiene; 1,5-cyclo-dodecadiene; 4-vinylcyclohexene; 1-allyl, 4-isopropylidene cyclohexane; 3-allyl-cyclopentene; 4-allylcyclohexene and 1-isopropenyl-4-(4-butenyl)cyclohexane.
d. Multi-single ring alicyclic dienes such as: 4,4'-dicyclopentenyl and 4,4'-dicyclohexenyl dienes.
e. Multi-ring alicyclic fused and bridged ring dienes such as: tetrahydroindene; methyl tetrahydroindene; dicyclopentadiene; bicyclo (2.2.1) hepta 2,5-diene; alkyl, alkenyl, alkylidene, cycloalkenyl and cycloalkylidene norbornenes such as: ethyl norbornene; 5-methylene-6-methyl-2-norbornene; 5-methylene-6, 6-dimethyl-2-norbornene; 5-propenyl-2-norbornene; 5-(3-cyclopentenyl)-2-norbornene and 5-cyclohexylidene-2-norbornene; norbornadiene; etc.

Other suitable hydrocarbon polymers may be made from styrene, and substituted styrenes, such as alkylated styrene, or halogenated styrene. The alkyl group in the alkylated styrene, which may be a substituent on the aromatic ring or on an alpha carbon atom, may contain from 1 to about 20 carbons, preferably 1–6 carbon atoms. These styrene type monomers may be copolymerized with suitable conjugated diene monomers including butadiene and alkyl-substituted butadiene, etc., having from 1 to about 6 carbons in the alkyl substituent. Thus, in addition to butadiene, isoprene, piperylene and 2,3-dimethylbutadiene are useful as the diene monomer. Two or more different styrene type monomers as well as two or more different conjugated diene monomers may be polymerized to form the interpolymers.

Still other useful polymers are derived without styrene and only from aliphatic conjugated dienes, usually having from 4 to 6 carbon atoms most usefully, butadiene. Examples are homopolymers of 1,3-butadiene, isoprene, 1,3-pentadiene, 1,3-dimethylbutadiene, copolymers formed with at least two of these conjugated dienes and copolymers of the latter with styrene, these homopolymers and copolymers having been hydrogenated. These aforesaid polymers with considerable unsaturation are preferably fully hydrogenated to remove substantially all of the olefinic unsaturation, although, in some situations, partial hydrogenation of the aromatic-type unsaturation is effected. These interpolymers are prepared by conventional polymerization techniques involving the formation of interpolymers having a controlled type of steric arrangement of the polymerized monomers, i.e. random, block, tapered, etc. Hydrogenation of the interpolymer is effected using conventional hydrogenation processes.

Polyisobutylenes are readily obtained in a known manner as by following the procedure of U.S. Pat. No. 2,084,501 wherein the isoolefin, e.g. isobutylene, is polymerized in the presence of a suitable Friedel-Crafts catalyst, e.g. boron fluoride, aluminum chloride, etc., at temperatures substantially below 0° C. such as at −40° C. Such isobutylenes can also be polymerized with a higher straight chained alpha-olefin of 6 to 20 carbon atoms as taught in U.S. Pat. No. 2,534,095 where said copolymer contains from about 75 to about 99% by volume of isobutylene and about 1 to about 25% by volume of a higher normal alpha-olefin of 6 to 20 carbon atoms. Copolymers of isobutylene with dienes such as isoprene or piperylene may also be used.

Ethylenically Unsaturated Carboxylic Acid Material

These materials which are grafted onto the ethylene copolymer contain 3 to 10 carbon atoms and at least one ethylenic unsaturation and at least one, preferably two, carboxylic acid groups, or an anhydride group, or a polar group which is convertible into said carboxyl groups by oxidation or hydrolysis. Maleic anhydride or a derivative thereof is preferred as it does not appear to homopolymerize appreciably but attaches onto the ethylene copolymer to give two carboxylic acid functionalities. Such preferred materials have the generic formula

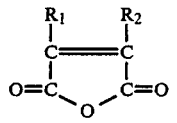

wherein $R_1$ and $R_2$ are hydrogen or a halogen. Suitable examples additionally include chloro-maleic anhydride, itaconic anhydride, hemic anhydride or the corresponding dicarboxylic acids, such as maleic acid or fumaric acid or their monoesters, etc.

As taught by U.S. Pat. Nos. 4,160,739 and 4,161,452 various unsaturated comonomers may be grafted on the olefin copolymer together with the unsaturated acid component, e.g. maleic anhydride. Such graft monomer systems may comprise one or a mixture of comonomers different from the unsaturated acid component and which contain only one copolymerizable double bond and are copolymerizable with said unsaturated acid component. Typically, such comonomers do not contain free carboxylic acid groups and are esters containing α,β-ethylenic unsaturation in the acid or alcohol portion; hydrocarbons, both aliphatic and aromatic, containing α,β-ethylenic unsaturation, such as the $C_4$–$C_{12}$ alpha olefins, for example isobutylene, hexene, nonene, dodecene, etc.; styrenes, for example styrene, α-methyl styrene, p-methyl styrene, p-sec. butyl styrene, etc.; and vinyl monomers, for example vinyl acetate, vinyl chloride, vinyl ketones such as methyl and ethyl vinyl ketone, etc. Comonomers containing functional groups which may cause crosslinking, gelation or other interfering reactions should be avoided, although minor amounts of such comonomers (up to about 10% by weight of the comonomer system) often can be tolerated.

Grafting of the Polymer

The grafting of the polymer with the carboxylic acid material may be by any suitable method, such as thermally by the "ene" reaction, using copolymers containing unsaturation, such as ethylene-propylene-diene polymers either chlorinated or unchlorinated, or more preferably it is by free-radical induced grafting either in the presence or absence of solvent, e.g. a mineral lubricating oil.

The radical grafting is preferably carried out using free radical initiators such as peroxides and hydroperoxides and preferably those which have a boiling point greater than about 100° C. and which decompose thermally within the grafting temperature range to provide said free radicals. Representative of these free-radical initiators are 2,5-di-methyl-hex-3-yne-2, 5 bis-tertiary-butyl peroxide (sold as Lupesol 130) or its hexane analogue, di-tertiary butyl peroxide and dicumyl peroxide. The initiator is generally used at a level of between about 0.005% and about 1%, based on the total weight of the polymer solution, and at temperatures of about 150° to 220° C.

The ethylenically unsaturated carboxylic acid material, preferably maleic anhydride, will be generally used in an amount ranging from about 0.1 to about 10%, preferably 0.5 to 5.0%, based on weight of the initial ethylene copolymer. The aforesaid carboxylic acid material and free radical initiator are generally used in a weight percent ratio range of 1.0:1 to 30:1, preferably 3.0:1 to 12:1.

The initiator grafting is preferably carried out at 120°–250° C., preferably 150°–220° C. An inert atmosphere, such as that obtained by nitrogen blanketing can be used. While the grafting can be carried out in the presence of air, the yield of the desired graft polymer is generally thereby decreased as compared to grafting under an inert atmosphere substantially free of oxygen. The grafting time will usually range from about 0.005 to 12 hours. If carried out in an extruder, the total time will be relatively short, e.g. 0.005 to 0.2 hours. In a masticator usually from about 0.5 to 6 hours, more preferably 0.5 to 3 hours total time will be required. If carried out in a solution, then similarly about 0.5 to 6 hours, e.g. 0.5 to 3 hours may be required. The graft reaction will be usually carried out to at least approximately 4 times, preferably at least about 6 times the half-life of the free-radical initiator at the reaction temperature employed, e.g. with 2,5-dimethyl hex-3-yne-2, 5-bis(t-butyl peroxide) 2 hours at 160° C. and one hour at 170° C., etc.

Grafting of ethylene copolymer with maleic anhydride is described in various U.S. patents such as U.S. Pat. Nos. 4,089,794; and 4,144,181.

The grafting technique used in several examples of the invention was by grafting the ethylene copolymer in the solid state with maleic anhydride using a free radical initiator together with a chain stopping agent to inhibit cross-linking. In this solid state grafting process, preferably the ethylene copolymer rubber is first heated to about 100°–160° C. and below the grafting temperature to facilitate mixing with the other ingredients, such as the unsaturated graft material, e.g. maleic anhydride, chain stopper and initiator, all of which are added with mixing to form a homogeneous mixture. The chain stopper is preferably added before the initiator. The reaction mixture can be further heated to grafting temperature, preferably in the range of about 170° to 240° C. Grafting temperature is the temperature where the initiator breaks down to form free radicals and cause substantial grafting to take place. When the reaction is complete, the excess monomer material may be eliminated by an inert gas purge, e.g. nitrogen sparging. Continuous or periodic addition of the graft material to the reactor can be utilized along with an appropriate portion of initiator and chain stopper during the course of the reaction.

The chain stopping agent is preferably an aliphatic mercaptan having 4 to 24 carbon atoms, such as t-butyl mercaptan, n-butyl mercaptan, octyl mercaptan, n-dodecyl mercaptan, t-dodecyl mercaptan, etc. The tertiary mercaptans and diethyl hydroxyl amine are particularly effective and are the most preferred. Other chain stopping agents may be used, for example, cumene, alcohols, phenols, etc. The chain stopper will be generally used in an amount of 0.05 to 10 wt. %, e.g. 0.1 to 5 wt. %, based on the weight of the polymer.

In some cases the grafting can take place in several stages by mixing the reactants together below the grafting temperature; heating to a higher temperature to graft; cooling below grafting temperature; adding and mixing more unsaturated material, initiator and chain stopper; heating again to the grafting temperature to graft the added material, etc. In still other cases, it may be desirable to heat the polymer to grafting temperature and add the chain stopper, the unsaturated acid or nitrogen monomer and the initiator all while at grafting temperatures. Alternatively, the chain stopper can be added to the polymer below grafting temperature, and the initiator and unsaturated acid or nitrogen monomer can be added at grafting temperatures.

After the grafting is complete, diluent oil, such as mineral lubricating oil, may be mixed into the grafted ethylene copolymer to form a concentrate. This dilution can be carried out in a masticator used for the grafting, or dilution can be carried out in a separate heating and mixing vessel. A further reaction with an amine or hydroxy component is carried out to form a V.I.—dipsersant additive. This will usually be carried out using the diluted grafted polymer, in a separate reaction vessel from that used for grafting.

The Polyamine Component

Useful amine compounds for neutralization of the acid, e.g. maleic anhydride, grafted hydrocarbon polymer include polyamines of about 2 to 60, e.g. 3 to 20, total carbon atoms and about 1 to 12, e.g., 2 to 7 nitrogen atoms in the molecule. These amines may be hydrocarbyl amines or may be hydrocarbyl amines including other groups, e.g., alkoxy groups, amide groups, imidazoline groups, and the like. Preferred polyamines are aliphatic saturated amines.

Non-limiting examples of suitable amines include: 3-dodecyloxypropylamine; mono-tallow amine; amino morpholines such as amino morpholine, N-(3-aminopropyl)morpholine and N-(2-aminoethyl)morpholine; substituted pyridines such as 2-amino pyridine, 2-methylamino pyridine and 3-methylamino pyridine; and others such as 2-aminothiazole; 2-amino-2-thiazoline; 2-amino pyrimidine; 2-amino benzothiazole; methyl-1-phenyl hydrazine and para-morpholino aniline, etc.

Useful amines also include piperadines and piperazines of the general formula

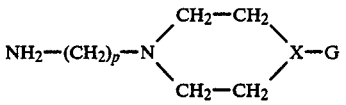

where X is CH-G (piperadines) or N-G (piperazines) where G is hydrogen or alkyl groups of 1 to 3 carbon atoms while p is 1 to 6.

Useful amines include pyridines of the structures:

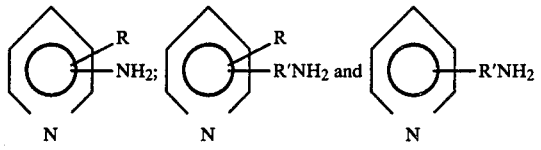

where R is a $C_1$ to $C_{24}$, e.g. $C_1$ to $C_8$ hydrocarbon group, e.g. alkyl group and R′ is a $C_1$ to $C_{24}$, e.g. $C_1$ to $C_8$ alkylene group.

Alcohol amines may also be used, such as those of the formula

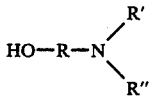

where R is a $C_2$ to $C_{24}$ alkylene group R′ and R″ are alkyl groups of 1 to 10 carbons, e.g. methyl, n-butyl, isobutyl, etc.

Especially preferred are amines having a single primary amine group, with any other amine groups present being tertiary amine groups. This inhibits cross-linking which is particularly important when the polymer has a relatively high degree of acidity, e.g. above 0.1 meq./g. of polymer. Mixtures comprising about 70 wt. % or more of amines having only a single primary or secondary group may be used with small amounts of amines having two or more primary or secondary amine groups. Acidities below 0.1 meq./g. polymer are less sensitive to cross-linking and amines with 2 or more reactive groups, i.e. either primary or secondary amine groups, or both primary and secondary amine groups, or a primary amine group and an alcohol group, may be used.

Examples of amines with 2 or more reactive groups which may be used include alkylene polyamines such as 1,2-diaminoethane; 1,3-diaminopropane and particularly polyethylene amines such as diethylene triamine, triethylene tetramine, etc.

The polyamines will be generally used in the range of 0.1 to 10 wt. %, preferably 0.5 to 5 wt. %, based on the weight of the ethylene copolymer. The polyamine is preferably used in an amount that neutralizes the acid moieties by formation of amides, imides or salts.

Preferably the amount of polyamine used in such that there is 1 to 2 moles of polyamine reacted per equivalent mole of dicarboxylic acid. For example, with an ethylene-propylene copolymer of 40,000 number average molecular weight, grafted with an average of 4 maleic anhydride groups per molecule, preferably about 4 to 8 molecules of polyamine is used per molecule of grafted ethylene-propylene copolymer.

Reaction of Grafted Hydrocarbon Polymer with Polyamine Component

The polymer, grafted with acidic moieties, preferably in solution generally equal to about 5 to 30 wt. %, preferably 10 to 20 wt. % polymer, can be readily reacted with polyamines by heating at a temperature of from about 100° C. to 250° C., preferably from 120° to 230° C., for from about 0.5 to 10 hours, usually about 1 to about 6 hours. The heating is preferably carried out to favor formation of imides and amides. Reaction ratios can vary depending upon the reactants, amounts of excess, type of bonds formed, etc.

Treatment with Ammonia or Monoamine to inhibit Viscosity Growth

After the reaction with the polyamine is substantially complete, and in the same or different reactor, the polyamine reaction product can then be treated with ammonia or with primary monoamine of the formula $RNH_2$ where R is a $C_1$ to $C_{24}$, preferably $C_2$ to $C_{12}$, e.g. $C_4$ to $C_8$ hydrocarbon group, either saturated or unsaturated, branched chain or straight chain, aliphatic, alicyclic, cyclic, or aromatic. Preferably R is a straight chain alkyl group. Some specific examples of such monoamines include n-butyl amine, isobutyl amine, n-pentyl amine, n-octyl amine, dodecyl amine, etc.

Usually the amount of ammonia or monoamine used will be 0.1 to 10 wt. %, preferably 0.5 to 8 wt. %, e.g. 0.5 to 5 wt. %, based on the weight of the ethylene copolymer. The ammonia or monoamine is also preferably heated to 100° to 250° C., preferably 120° to 200° C. for 0.5 to 10, preferably 1 to 6 hours, together with the grafted copolymer after it has been reacted with the polyamine. Usually the monoamine is just simply added to the reaction mixture after the acid grafted ethylene copolymer has had sufficient time to react with the polyamine. After the polyamine has reacted, the reaction mixture is cooled below the boiling point of the monoamine before adding the monoamine if it has a low boiling point, and then reheating to complete the treatment of reaction.

Compositions

A minor amount, e.g. 0.001 up to 50 wt. %, preferably 0.005 to 25 wt. %, based on the weight of the total composition, of the oil-soluble graft hydrocarbon polymers produced in accordance with this invention can be incorporated into a major amount of an oleaginous material, such as a lubricating oil or hydrocarbon fuel, depending upon whether one is forming finished products or additive concentrates. When used in lubricating oil compositions, e.g., automotive or diesel crankcase lubricating oil, the final grafted polymer V.I.—dispersant concentrations are usually within the range of about 0.01 to 10 wt. %, e.g., 0.1 to 6.0 wt. %, preferably 0.25 to 3.0 wt. %, of the total composition. The lubricating oils to which the products of this invention can be added include not only hydrocarbon oil derived from petroleum, but also include synthetic lubricating oils such as esters of dicarboxylic acids; complex esters made by esterification of monocarboxylic acids, polyglycols, dicarboxylic acids and alcohols; polyolefin oils, etc.

The V.I.—dispersant graft polymers of the invention may be utilized in a concentrate form, e.g., from about 5 wt.% up to about 50 wt. %, preferably 7 to 25 wt. %, in 95 to 50 wt. %, preferably 93 to 75 wt. % oil, e.g., mineral lubricating oil, for ease of handling.

The above oil compositions may contain other conventional additives, such as pour point depressants, antiwear agents such as tricresyl phosphate or zinc dithiophosphates, antioxidants such as N-phenylα-naphthylamine, t.-octyl phenol sulfide, 4,4'-methylene bis(2,6-di-tertbutyl phenol), viscosity index improvers such as ethylene-propylene copolymers, polymethacrylates, polyisobutylene, alkyl fumarate-vinyl acetate copolymers and the like, as well as other ashless dispersants such as other polyisobutylene succinic anhydrides reacted with amines, hydroxy amines, polyols, etc.

The following examples, wherein all parts are parts by weight, which include preferred embodiments, further illustrate the present invention.

EXAMPLE 1

100 lbs. of solid ethylene-propylene copolymer rubber was added to a 50 gal. rubber masticator, operating at a slow speed, in the form of five 20 lb. pieces. The copolymer was initially masticated under nitrogen for 90 minutes in a Dow-Therm heated masticator at a temperature of about 350° F. Three pounds of t. dodecyl mercaptan was added through a dropping funnel over a 20 minute period, followed by the addition of 2.0 lbs. of melted maleic anhydride, added through said dropping funnel. Initially, 100 ml. of the maleic anhydride was added. Then the remaining maleic anhydride was added over a 15 minute period simultaneously while adding about 0.9 lbs. of 1.13 lbs. of a nitrogen sparged initiator solution that had been made up consisting of 0.13 lbs. of ditertiary butyl peroxide dissolved in a mixture consisting of 0.7 lbs. of PIB 500 and 0.3 of a lb. of ISOPAR M which is a hydrocarbon solvent. After this 15 minute period, then the remaining initiator solution was added over about 9 minute period. This last addition was followed by soaking and mixing for about 5 minutes, followed by nitrogen stripping for 20 minutes. Then 425 lbs. of S100NLP (Solvent Neutral mineral lubricating oil of 100 SUS viscosity at 37.8° C., low pour) oil, which have been previously sparged with nitrogen to remove moisture and volatiles, were added to the masticator in a series of small increments e.g. about 10 to 50 pounds or more, each increment being mixed into the reaction mass before the next increment. Then the masticator was drained to give the oil solution of the ethylene copolymer rubber grafted with maleic anhydride.

The ethylene-propylene copolymer used above was a V.I. improver for lubricating oil and consisted of about 43 wt. % ethylene and about 57 weight % propylene. It had a Thickening Efficiency (T.E.) of about 2.8 which represents a number average molecular weight of approximately 60,000. It was an amorphous copolymer with a $\overline{M}_w/\overline{M}_n$ of less than 4:1.0.

Thickening Efficiency (T.E.) is defined as the ratio of the weight percent of a polyisobutylene (sold as an oil solution by Exxon Chemical Co. As Paratone N), having a Staudinger Molecular Weight of 20,000, required to thicken a solvent-extracted neutral mineral lubricating oil, having a viscosity of 150 SUS at 37.8° C., a viscosity index of 105 and an ASTM pour point of 0° F., (Solvent 150 Neutral) to a viscosity of 12.4 centistokes at 98.9° C., to the weight percent of a test copolymer required to thicken the same oil to the same viscosity at the same temperature. T.E. is related to ($\overline{M}_n$) and is a convenient, useful measurement for formulation of lubricating oils of various grades.

EXAMPLE 2

500 g. of the Product of Example 1, that is the oil solution of maleic anhydride grafted ethylene-propylene copolymer were charged to a 2 liter laboratory resin kettle along with 500 g. of S100NLP mineral lubricating oil. The kettle was equipped with a heating mantle, a dropping funnel, stirrer, overhead water condenser, vacuum pump and a nitrogen inlet for maintaining a nitrogen atmosphere. The temperature was raised to 190° C. while stirring and nitrogen sparging to remove any moisture or volatiles. Then 1.8 g of N-aminopropyl morpholine (NAPM) were added over 10 minutes, followed by continued heating at 190° C. and mixing while under nitrogen for one hour. A 166.4 g sample (Sample A) was taken. The temperature of the remaining material was lowered to 60° C. and 3.33 g. of n-butyl amine were added. The temperature was raised to 90° C. over about 10 minutes and maintained for about 1 hour, followed by raising to 190° C. over about 35 minutes, and then followed by nitrogen sparging for one hour at 190° C. The reactor was then cooled to 150° C. and the contents drained to give the Final Product of Example 2 which was an oil solution of the maleic anhydride grafted ethylene-propylene rubber reacted with NAPM and normal butyl amine. This Final Product had a K.V. (Kinematic Viscosity) of 1864 centipoise at 100° C. and was useful as a Viscosity Index improving—sludge dispersant additive, e.g. for lubricating oils.

Final Product of Example 2, along with Sample A, were tested for storage stability by storing in an oven at 80° C. and testing for storage stability. The results are summarized in the following Table I.

TABLE 1

| | Storage Stability Test | |
|---|---|---|
| | K.V. @ 100° C. | %/hr. Viscosity Growth |
| Final Product Example 2 (Butyl Amine Used) | | |
| Initial | 1864 | |
| 2 Weeks | 1951 | .014 |
| 3 Weeks | 2013 | .016 |
| 1 Month | 2058 | .015 |
| 2 Months | 2273 | .012 |
| Sample A (No Butyl Amine) | | |
| Initial | 1904 | |
| 2 Weeks | 2103 | .029 |
| 3 Weeks | 2197 | .031 |
| 1 Month | 2252 | .027 |
| 2 Months | 2574 | .026 |

Table 1 illustrates the improvement in inhibition of viscosity increase by the addition of the butyl amine (Final Product of Example 2) as opposed to just reacting with the NAPM (Sample A). Nitrogen analysis (micro-Kjeldahl) in duplicate, showed Sample A had 0.221//0.221 wt. % nitrogen, while the Final Product analyzed 0.224/0.229 wt. % nitrogen.

EXAMPLE 3

Example 2 was repeated except that 2.1 pounds of maleic anhydride was used in place of the 1.9 pounds of Example 1, and the temperature over which said additives and mixing of mercaptan, maleic anhydride and initiator solutions were made ran from about 212° F. to about 270 when said final nitrogen stripping was begun.

EXAMPLE 4

The 2 liter resin kettle was charged with 500 g. of maleic anhydride grafted ethylene-propylene oil concentrate of Example 3, and 500 g. of S100NLP. The temperature was raised to 190° while nitrogen sparging. Then 1.8 g. of NAPM was added over 20 minutes followed by a one hour soak at 190° C. Next, a 149.1 g. sample (Sample B) was taken. The temperature of the remaining material was lowered to 60° C. so as to be below the boiling point of the 3.40 g. of n-butyl amine that was then added. The temperature was raised to 90° C., followed by a two hour soak period, followed by raising the temperature to 190° C. The reaction mixture was then nitrogen stripped for one hour, after which said mixture was cooled to 150° C. and drained from the reactor to give the Final Product of Example 4.

The Storage Stability Test data are summarized in Table 2.

TABLE 2

| | Storage Stability Test | |
|---|---|---|
| | K.V. @ 100° C. | %/hr. Viscosity Growth |
| Final Product Example 4 (Butyl Amine Used) | | |
| Initial | 1344 | |
| 2 Weeks | 1749 | .090 |
| 3 Weeks | 1872 | .078 |
| 1 Month | 2000 | .073 |
| 2 Months | 3025 | .093 |
| Sample B (No Butyl Amine) | | |
| Initial | 1261 | |
| 2 Weeks | 1801 | .127 |
| 3 Weeks | 2014 | .118 |
| 1 Month | 2149 | .105 |
| 2 Months | 3388 | .125 |

Nitrogen analysis in duplicate showed the Final Product of Example 4 had 0.303/0.298 wt. % nitrogen, while Sample B had 0.304/0.299 wt. % nitrogen. As seen by Table 2, the added treatment with the butyl amine (Final Product Example 4) improved the storage stability as compared to the material of Sample B.

EXAMPLE 5

Example 3 was repeated except the temperature rose from about 210° F. during said additions and mixing up to about 260° F. when said final stripping was begun.

EXAMPLE 6

The 2 liter resin kettle was charged with 500 g. of the oil concentrate of Example 5 containing the maleic anhydride grafted ethylene-propylene copolymer and 500 g. of S100NLP. The temperature was raised to 150° C. while stirring and nitrogen sparging for one hour. The 3 g. of NAPM was added over 5 minutes and reacted for an hour, after which 1.35 g. of n-hexyl amine mixed with 1.35 g. of S100NLP were added over about 15 minutes. The temperature was maintained at 150° C. for 2 hours while stirring, followed by 3 hours of nitrogen stripping at 150° C. The reactor was then drained to give the Final Product having a K.V. @ 100° C. of 1387 centipoises A storage stability test was carried out with the following results as summarized in Table 3.

TABLE 3

| | Storage Stability Test | |
|---|---|---|
| Final Product Example 6 | K.V. @ 100° C. | %/hr. Viscosity Growth |
| Initial | 1387 | — |
| 2 Weeks | 1516 | .028 |
| 1 Month | 1604 | .021 |
| 2 Months | 1796 | .020 |

EXAMPLES 7 to 9

Samples of an oil concentrate made in a manner similar to Example 5 (Conc. Example 5) were treated with different monoamines following the general procedure of Example 6 except for the changes noted in Table 4. Table 4 also summarized the viscosity stability of these monoamine treated samples.

TABLE 4

| | STORAGE STABILITY TEST | | |
|---|---|---|---|
| | Examples | | |
| | 7 | 8 | 9 |
| g. Conc. Ex. 5. | 500 | 500 | 500 |
| g. S100NLP | 500 | 500 | 500 |
| g. NAPM | 3 | 3 | 3 |
| Temp. °C. NAPM added | 150° C. | 150° C. | 150° C. |
| Time NAPM reacted | 1 hr. | 1 hr. | 0.5 hr. |
| g. Monoamine added | 4 g. n-butyl amine | 5.5 g. n-hexyl amine | 3.5 g. n-octyl-amine |
| Temp. Monoamine reacted | 150° C. | 150° C. | 150° C. |
| Time Monoamine reacted | 2 hr. | 2 hr. | 2 hr. |
| Time N stripping @ °C. | 3 hr. @ 150° C. | 2.5 hr. @ 150° C. | 3 hr. @ 150° C. |
| Wt. % N (micro-Kjeldahl) | .327/.334 | .282/.278 | .323/.322 |
| Viscosity, K.V. @ 100° C. | | | |
| Initial | 1245 | 884 | 1389 |
| 2 Weeks | 1357 | — | 1455 |
| 1 Month | 1457 | 1087 | 1631 |
| 2 Months | 1630 | 1195 | 1846 |
| Viscosity Growth, %/hr. | | | |

TABLE 4-continued

| STORAGE STABILITY TEST | Examples | | |
|---|---|---|---|
| | 7 | 8 | 9 |
| 2 Weeks | .027 | — | .014 |
| 1 Month | .025 | .032 | .026 |
| 2 Months | .023 | .026 | .024 |

What is claimed is:

1. An oil composition comprising a major amount of a lubricating oil and a viscosity index improving amount of an oil-soluble hydrocarbon polymeric viscosity index improver having dispersancy properties which is a hydrocarbon polymer of $C_2$ to $C_{28}$ olefin grafted with an ethylenically unsaturated acid material selected from the group consisting of unsaturated carboxylic acids and anhydrides of carboxylic acid, and reacted with polyamine of 2 to 60 carbons and 2 to 12 nitrogens having at least 70 wt. % polyamine having a single primary of secondary amine group; and a basic nitrogen containing material selected from the group consisting of hydrocarbyl monoamine having 1 to 24 carbon atoms and ammonia.

2. A composition according to claim 1, wherein said hydrocarbon polymer is a hydrogenated copolymer of styrene with at least one aliphatic diene selected from the group consisting of butadiene and isoprene.

3. A composition according to claim 2, wherein said hydrocarbon polymer is a hydrogenated polymer of blocks of styrene with blocks of said diene.

4. A composition according to claim 1, wherein said hydrocarbon polymer is a copolymer of ethylene with a $C_3$ to $C_{28}$ alpha olefin.

5. A composition according to claim 4, wherein said hydrocarbon polymer consists essentially of ethylene and propylene.

6. A composition according to claim 1, wherein said improver is present in an amount of from about 0.1 to 10 wt. %, based upon the total weight of said composition, and is an ethylene-propylene copolymer having a number average molecular weight from about 700 to 500,000 which is grafted with maleic anhydride, reacted with a tertiary polyamine having a single primary amine group and an alkyl monoamine.

7. A composition according to claim 6, wherein said polyamine is N-aminopropyl morpholine.

8. A composition according to claim 7, wherein said basic nitrogen containing material is an aliphatic hydrocarbyl monoamine containing 2 to 12 carbon atoms.

9. A composition according to claim 8, wherein said monoamine is an alkyl amine.

10. A composition according to claim 6, wherein said ethylene copolymer is grafted with 0.1 to 10 wt. % maleic anhydride; which is reacted with, in the range of 0.1 to 10 wt. % of said polyamine and in the range of 0.1 to 10 wt. % of said monoamine or ammonia; all of said wt. % of maleic anhydride, polyamine and monamine or ammonia being based on the weight of said ethylene copolymer.

11. A composition according to claim 1, wherein said composition is an additive concentrate comprising about 95 to 50 wt. % mineral lubricating oil and about 5 to 50 wt. % of said improver.

12. A composition according to claim 1, wherein said composition is a lubricant comprising about 0.01 to 10 wt. % of said improver.

13. An oil-soluble additive which is an ethylene copolymer comprising about 30 to 80 wt. % ethylene and about 20 to 70 wt. % $C_3$ to $C_{28}$ alpha olefin, grafted with an ethylenically unsaturated acid material selected from the group consisting of unsaturated carboxylic acids and anhydrides of carboxylic acid, and reacted with polyamine of 2 to 60 carbons and 2 to 12 nitrogens having at least 70 wt. % polyamine having a single primary or secondary amine group; and a basic nitrogen containing material selected from the group consisting of hydrocarbyl monoamine having 1 to 24 carbon atoms and ammonia.

14. An oil-soluble additive according to claim 13, wherein said copolymer is an ethylene-propylene copolymer having a number average molecular weight from about 700 to 500,000 which is grafted with maleic anhydride, reacted with a tertiary polyamine having a single primary amine group and an alkyl monoamine.

15. An oil-soluble additive according to claim 14, wherein said polyamine is N-aminopropyl morpholine.

16. An oil-soluble additive according to claim 15, wherein said basic nitrogen containing material is an aliphatic hydrocarbyl monoamine containing 2 to 12 carbon atoms.

17. An oil-soluble additive according to claim 16, wherein said monoamine is an alkyl amine.

18. An oil-soluble additive acording to claim 13, wherein said ethylene copolymer is grafted with 0.1 to 10 wt. % maleic anhydride; which is reacted with, in the range of 0.1 to 10 wt. % of said polyamine and in the range of 0.1 to 10 wt. % of said monoamine or ammonia; all of said wt. % of maleic anhydride, polyamine and monoamine or ammonia being based on the weight of said ethylene copolymer.

* * * * *